US006905083B2

(12) United States Patent
Ricco

(10) Patent No.: US 6,905,083 B2
(45) Date of Patent: Jun. 14, 2005

(54) INTERNAL COMBUSTION ENGINE FUEL INJECTOR AND RELATIVE FABRICATION METHOD

(75) Inventor: Mario Ricco, Casamassima (IT)

(73) Assignee: C.R.F. Societá Consortile per Azioni, Strada Torino (IT)

( * ) Notice: Subject to any disclaimer, the term of this patent is extended or adjusted under 35 U.S.C. 154(b) by 211 days.

(21) Appl. No.: 10/218,363

(22) Filed: Aug. 14, 2002

(65) Prior Publication Data

US 2003/0051700 A1 Mar. 20, 2003

(30) Foreign Application Priority Data

Aug. 14, 2001 (IT) ..... TO2001A0814

(51) Int. Cl.[7] ..... F02M 59/00; F02M 39/00; B05B 1/30

(52) U.S. Cl. ..... 239/533.2; 239/533.3; 239/533.8; 239/533.11; 239/585.1; 239/585.5

(58) Field of Search ..... 239/533.2, 533.3, 239/533.7, 533.8, 533.9, 533.11, 585.1–585.5, 88–93; 251/129.15, 129.21; 29/890.124, 890.127

(56) References Cited

U.S. PATENT DOCUMENTS

| | | | | |
|---|---|---|---|---|
| 3,610,529 A | | 10/1971 | Huber | 239/96 |
| 5,608,368 A | * | 3/1997 | Ricco et al. | 335/281 |
| 5,636,615 A | * | 6/1997 | Shorey et al. | 123/506 |
| 5,779,149 A | * | 7/1998 | Hayes, Jr. | 239/124 |
| 5,826,561 A | * | 10/1998 | Mack et al. | 123/446 |
| 6,027,037 A | * | 2/2000 | Murakami et al. | 239/88 |
| 6,161,774 A | * | 12/2000 | Ricco | 239/127 |
| 6,293,254 B1 | * | 9/2001 | Crofts et al. | 123/467 |

FOREIGN PATENT DOCUMENTS

| | | | |
|---|---|---|---|
| DE | 198 49 933 A1 | 5/2000 | F02M/51/06 |
| EP | 0 385 399 A2 | 9/1990 | F02M/51/06 |
| EP | 0 450 532 A1 | 10/1991 | F02M/47/00 |
| EP | 0 916 842 A1 | 5/1999 | F02M/47/02 |

* cited by examiner

*Primary Examiner*—Davis Hwu
(74) *Attorney, Agent, or Firm*—Dickstein, Shapiro, Morin & Oshinsky, LLP.

(57) ABSTRACT

The injector has an injector body having a seat for a metering valve in turn having a control chamber for controlling a control rod. The control chamber has an inlet conduit and a drain conduit controlled by a shutter, and is defined by two parts, one of which is defined by a bush having a through opening for guiding the control rod, and the other of which is defined by a plug member for closing the control chamber. The inlet conduit is located on the bush, and the drain conduit on the plug member. The bush is of such a diameter as to interfere slightly with at least one cylindrical portion of the seat, and is driven in fluidtight manner inside the seat so that an end edge rests on a shoulder of the seat. The plug member is fixed in fluidtight manner to the opposite end of the bush by means of a ring nut having a projection which acts along the centerline of the thickness of the bush.

17 Claims, 4 Drawing Sheets

INTERNAL COMBUSTION ENGINE FUEL INJECTOR AND RELATIVE FABRICATION METHOD

The present invention relates to an internal combustion engine fuel injector comprising an injector body having a seat for a metering valve in turn having an injector control rod control chamber; and to a method of fabricating the injector.

BACKGROUND OF THE INVENTION

As is known, the injector metering valve control chamber is supplied with pressurized fuel by an inlet conduit communicating with the delivery side of a high-pressure pump via a high-pressure fuel vessel common to all the injectors, and also has a drain conduit normally closed by a shutter controlled by the armature of an electromagnet.

The metering valve of the injector is normally defined by a valve body in the form of a sleeve closed at one end by an end wall comprising the drain conduit of the control chamber; the lateral wall of the sleeve guides the control rod controlling opening of the injector nozzle, and comprises the control chamber inlet conduit; and the valve body is housed in a seat in the injector body, and has a flange which is locked hermetically against a shoulder of the injector body by a threaded ring nut.

Known injectors of this sort have various drawbacks. In particular, machining inside the valve body is difficult, especially in the region of the end wall which must define the precise volume of the control chamber; the outer surface of the sleeve must form a chamber for distributing fuel from the delivery side of the high-pressure pump to the control chamber inlet conduit, so that one or more high-pressure fuel seals must be provided between the outer surface of the sleeve and the relative seat in the injector body; the presence of the seals complicates assembly of the injector components; and the locking action of the ring nut on the valve body flange is distributed over a relatively extensive area of the flange.

SUMMARY OF THE INVENTION

It is an object of the present invention to provide an internal combustion engine fuel injector which is extremely reliable, is cheap and easy to produce, and provides for eliminating the drawbacks of known injectors.

According to the present invention, there is provided an internal combustion engine fuel injector comprising an injector body having a seat for a metering valve in turn having a control chamber for controlling a control rod; said control chamber having a pressurized-fuel inlet conduit, and a drain conduit controlled by a corresponding shutter; characterized in that said control chamber is defined by two coaxial parts fixed in said seat; one of said parts guiding said control rod and having one of said conduits; and the other of said parts closing said control chamber and having the other of said conduits.

According to the present invention, there is also provided a fabrication method, characterized by comprising the steps of:

forming said injector body with a seat for said metering valve;

forming said control chamber in two parts, one for guiding said control rod and having one of said conduits, and the other for closing said control chamber and having the other of said conduits;

subsequently inserting said parts inside said seat; and locking said parts to each other in said seat by means of a fastening member.

Given the importance of the response time of injector metering valves to control by the electromagnet, and since response time can be adjusted by adjusting the diameter of the control chamber inlet and/or drain conduit, the metering valve must have a given pair of conduit diameters for each type of engine. In known technology, for a given injector, a wide range of metering valves must therefore be fabricated, each with the given pair of conduit diameters designed for the type of engine to which the injector is fitted. The injectors according to the invention therefore have the advantage of enabling the two component parts of the metering valve control chamber to be selected, at assembly, with the required two conduit diameters, thus simplifying part storage during fabrication.

BRIEF DESCRIPTION OF THE DRAWINGS

A number of preferred, non-limiting embodiments of the invention will be described by way of example with reference to the accompanying drawings, in which.

DETAILED DESCRIPTION OF THE INVENTION

Figure 1:
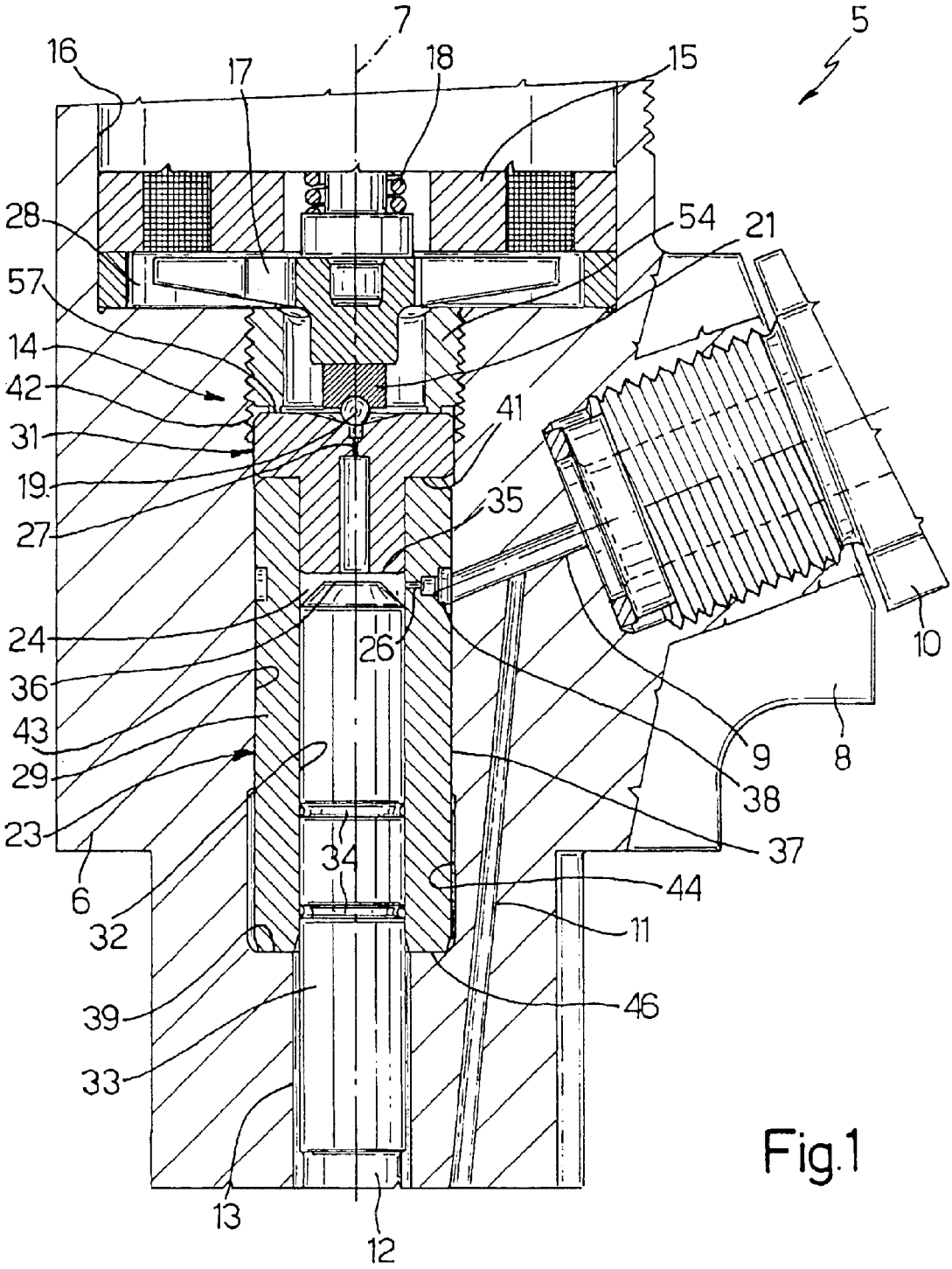
FIG. 1 shows a partial mid-section of a fuel injector in accordance with a first embodiment of the invention.

Number 5 in FIG. 1 indicates as a whole an internal combustion engine fuel injector comprising a hollow, tapering injector body 6 having an axis 7 and shown only partly in FIG. 1. One end of injector body 6, at the bottom in FIG. 1, has a nozzle (not shown) with one or more injection orifices normally closed by a pin. Injector body 6 also comprises an appendix 8 having a pressurized-fuel supply conduit 9 communicating with a fitting 10 connected to a high-pressure fuel pump via a high-pressure fuel vessel or so-called common rail common to all the injectors on the engine.

Conduit 9 communicates with the injector nozzle via a conduit 11. The pin closing the nozzle is normally kept in the closed position by a cylindrical control rod 12 movable axially along a seat 13 formed in injector body 6 and coaxial with axis 7. Control rod 12 is controlled by a metering valve indicated as a whole by 14 and controlled by a normally de-energized electromagnet 15 housed in another seat 16 formed in injector body 6, at the opposite end to the nozzle, and also coaxial with axis 7. More specifically, electromagnet 15 controls an armature 17 which is movable, and secured in any known manner, inside seat 16, and which is pushed by a spring 18 to act on a shutter of valve 14 defined, for example, by a ball 19 associated with a plate 21 having a locating cavity.

Metering valve 14 is housed in another seat 23 coaxial with axis 7 and between seat 13 of rod 12 and seat 16 of electromagnet 15, and comprises a control chamber 24 having a fuel inlet conduit with a calibrated hole 26, and a fuel drain conduit with another calibrated hole 27. Calibrated hole 27 is normally closed by ball 19 of shutter 19, 21, while pressurized fuel is fed continually into control chamber 24 through calibrated hole 26, and pushes rod 12 downwards into the FIG. 1 position to keep the nozzle of injector 5 closed.

When electromagnet 15 is energized, armature 17 is raised to release plate 21 and ball 19, so that the fuel in control chamber 24 is drained through calibrated hole 27 and a drain chamber 28, and rod 12 is raised by the pressure of the fuel acting on the opposite end, and possibly also by an auxiliary spring (now shown), so that the pin opens the nozzle.

According to the invention, control chamber 24 is formed in two coaxial parts 29, 31 fixed inside intermediate seat 23 in injector body 6. One of the two parts is defined by a hollow member defined by a cylindrical bush 29, which is fixed inside intermediate seat 23 as shown in detail later on, comprises calibrated hole 26 of the inlet conduit, and has a cylindrical through opening 32 in which is guided a portion 33 of control rod 12. The other of the two parts defining control chamber 24 is defined by a plug member 31 having calibrated hole 27 of the drain conduit, and which is also fixed inside intermediate seat 23 of body 6.

Cylindrical opening 32 of bush 29 must be precision machined to guide portion 33 of rod 12 accurately in its movement, while at the same time sealing in the pressurized fuel; portion 33 comprises two annular grooves 34 for lubricating opening 32 with the same fuel; plug member 31 comprises a bottom surface 35 for arresting an end surface 36 of rod 12 defining the bottom of control chamber 24; and end surface 36 is truncated-cone-shaped so as to leave the outlet of inlet conduit 26 clear even when rod 12 is in the top limit position.

Bush 29 has a precision machined cylindrical outer surface 37 comprising an annular groove 38 forming a distribution chamber for distributing pressurized fuel from conduit 9 to calibrated hole 26 of the inlet conduit of control chamber 24, and terminates with two annular end edges 39 and 41, which are also precision machined, also as regards squareness with respect to axis 7.

The diameter of portion 33 of rod 12 may advantageously be at least half the diameter of outer surface 37 of bush 29. Preferably, the diameter of portion 33 of rod 12 may be roughly 4.3 mm, and the diameter of outer surface 37 may be 8 mm or less.

Intermediate seat 23 of metering valve 14 comprises a top portion 42, a perfectly cylindrical intermediate portion 43, and a bottom portion 44. Top portion 42 is threaded for the purpose explained later on; cylindrical intermediate portion 43 is precision machined to receive surface 37 of bush 29; and bottom portion 44 of seat 23 is slightly larger in diameter than intermediate portion 43, and forms an annular shoulder 46 with seat 13.

To fix bush 29 inside intermediate seat 23, cylindrical portion 43 of seat 23 and outer surface 37 of bush 29 are machined to interfere slightly, so that bush 29 can be driven easily inside seat 23 with no danger of deforming bush 29 or injector body 6, while at the same time ensuring perfect sealing of the pressurized fuel in annular groove 38, both upwards in FIG. 1 and downwards. Bush 29 is driven inside seat 23 so that edge 39 contacts annular shoulder 46 of portion 44, thus accurately defining the axial position of bush 29 inside its seat. Said interference may preferably range between 5 and 10 microns, and the surface of portion 43 and/or surface 37 of bush 29 may be lapped, as opposed to ground, to reduce fabrication cost.

Plug member 31 comprises a top surface 47 (FIG. 2) having a truncated-cone-shaped depression 48 coaxial with calibrated hole 27 and for centering the action of ball 19 on hole 27. In addition to calibrated hole 27, the drain conduit also comprises a larger-diameter prehole 49 forming an additional volume to that of control chamber 24; plug member 31 comprises an annular surface 50 contacting the top edge 41 of bush 29, and which is precision machined to engage edge 41 in pressurized-fuel tight manner; and plug member 31 comprises a lateral surface 51 of substantially the same diameter as outer surface 37 of bush 29, and which engages with a minimum amount of clearance the cylindrical surface of a connecting portion 52 between intermediate portion 43 and threaded portion 42 of intermediate seat 23.

Top surface 47 of plug member 31 comprises an annular portion 53, which is also precision machined and is engaged by a ring nut 54 having an externally threaded lateral wall 56 by which it screws inside threaded portion 42 of intermediate seat 23. Ring nut 54 has substantially the same outside diameter as the lateral surface of plug member 31 and outer surface 37 of bush 29, so that its action in fastening plug member 31 is exerted on the thickness of bush 29, with no lever arm being formed with the pressure of the fuel in control chamber 24 or with the reaction of shoulder 46 of portion 44 of intermediate seat 23.

The thickness of wall 56 of ring nut 54 is preferably about 40% that of bush 29, and, to concentrate the fastening action of ring nut 54 on a small surface area of plug member 31, ring nut 54 has a bottom annular projection 57 of a width equal to about a third of the thickness of wall 56. Moreover, projection 57 is located adjacent to the inner surface of wall 56, so as to act substantially along the centerline of the thickness of bush 29.

Figure 2:
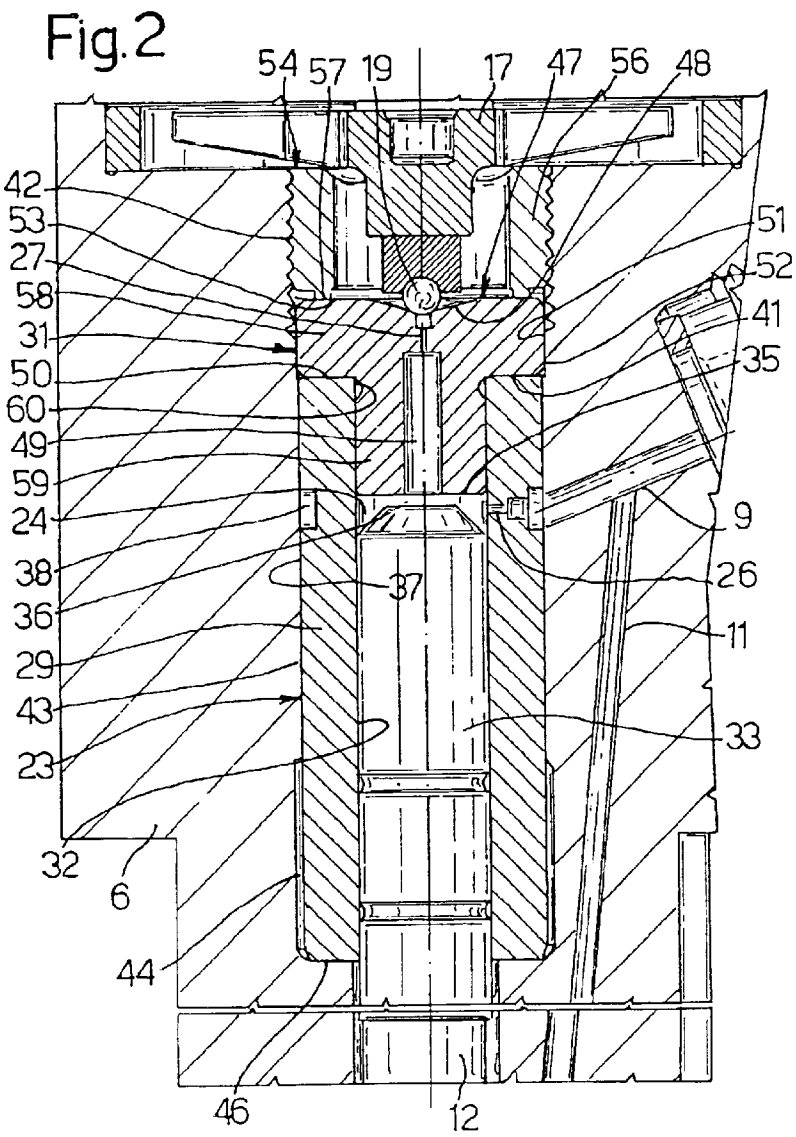
FIG. 2 shows a larger-scale section of a detail in FIG. 1.

In the FIG. 1 and 2 embodiment, plug member 31 comprises a flange 58 integral with a coaxial cylindrical appendix 59 having flat bottom surface 35 of plug member 31. Appendix 59 is housed with a limited amount of clearance inside opening 32 of bush 29, and is of such a length as to leave the outlet of calibrated hole 26 of the inlet conduit clear. Flat surface 35, the length of prehole 49, and truncated-cone-shaped end surface 36 of rod 12 therefore define the volume of control chamber 24. Obviously, on account of the length of prehole 49, calibrated hole 27 is preferably formed through the truncated-cone-shaped top surface 48 of plug member 31.

In the FIG. 2 embodiment, appendix 59 of plug member 31 comprises an annular groove 60 adjacent to flange 58 to permit precision machining of the lateral surface of appendix 59 and surface 50 of flange 58. Sealing between flange 58 and the surface of top edge 41 is achieved easily over the whole surface of edge 41 by the squareness of edge 41 and surface 50 of flange 58 with respect to axis 7.

To assemble metering valve 14 inside injector 6, bush 29 is first driven inside cylindrical portion 43 of intermediate seat 23—e.g. by first heating body 6 and cooling bush 29 with liquid nitrogen—so that edge 39 of bush 29 rests on shoulder 46 of portion 44 of seat 23. Appendix 59 of plug member 31 is then inserted inside opening 32 of bush 29. And finally, ring nut 54 is screwed inside threaded portion 42 of seat 23 to so fasten surface 50 of plug member 31 against top edge 41 of bush 29 as to ensure sealing of the pressurized fuel in chamber 24.

Figure 3:
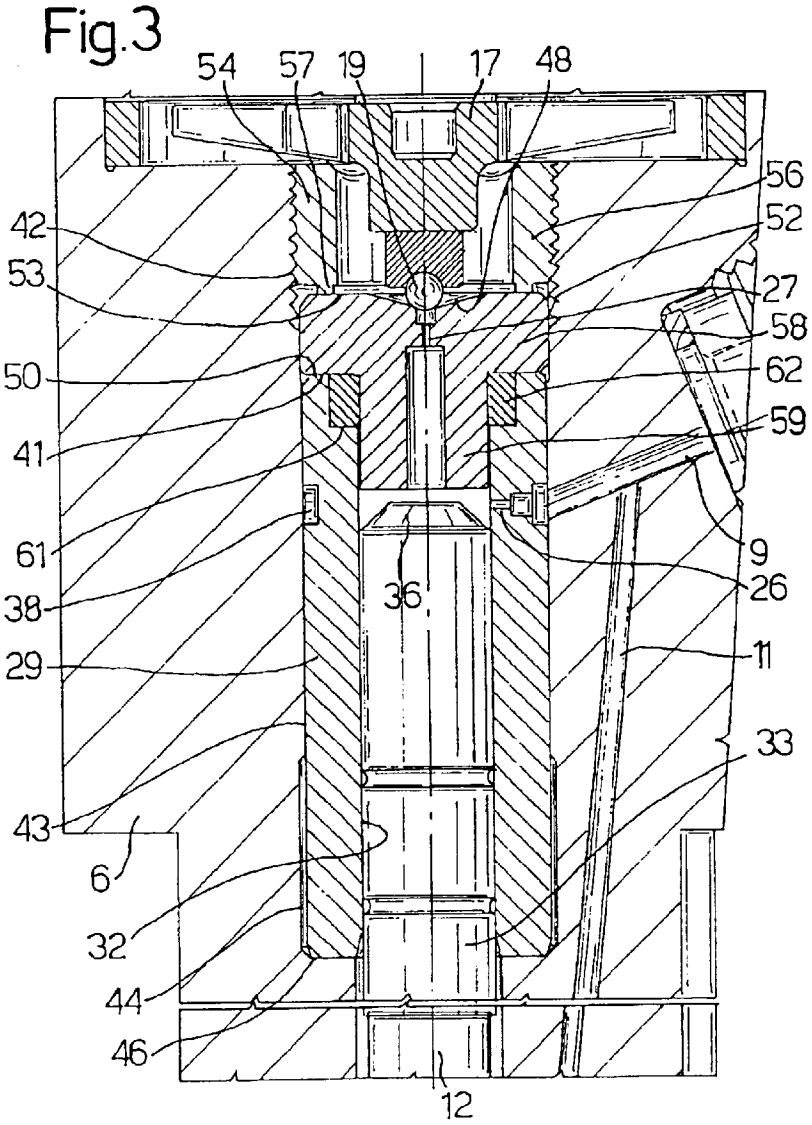
FIG. 3 shows the same section of a variation of the FIG. 2 embodiment.

In the FIG. 3 variation, the inner portion of top edge 41 of bush 29 has an annular recess 61 housing a seal 62 of elastomeric material. Seal 62 provides for sealing between flange 58 and edge 41 of bush 29 over a smaller diameter than in FIGS. 1 and 2, so that less fastening pressure is required of ring nut 54, and groove 60 in FIG. 2 may also be dispensed with, since such sealing may even be achieved in the presence of minor roughness of the portion of metal surface 50 adjacent to appendix 59. Obviously, in addition to the steps described relative to the FIGS. 1 and 2 injector, assembly of metering valve 14 in FIG. 3 also comprises inserting seal 62 inside annular recess 61.

Figure 5:
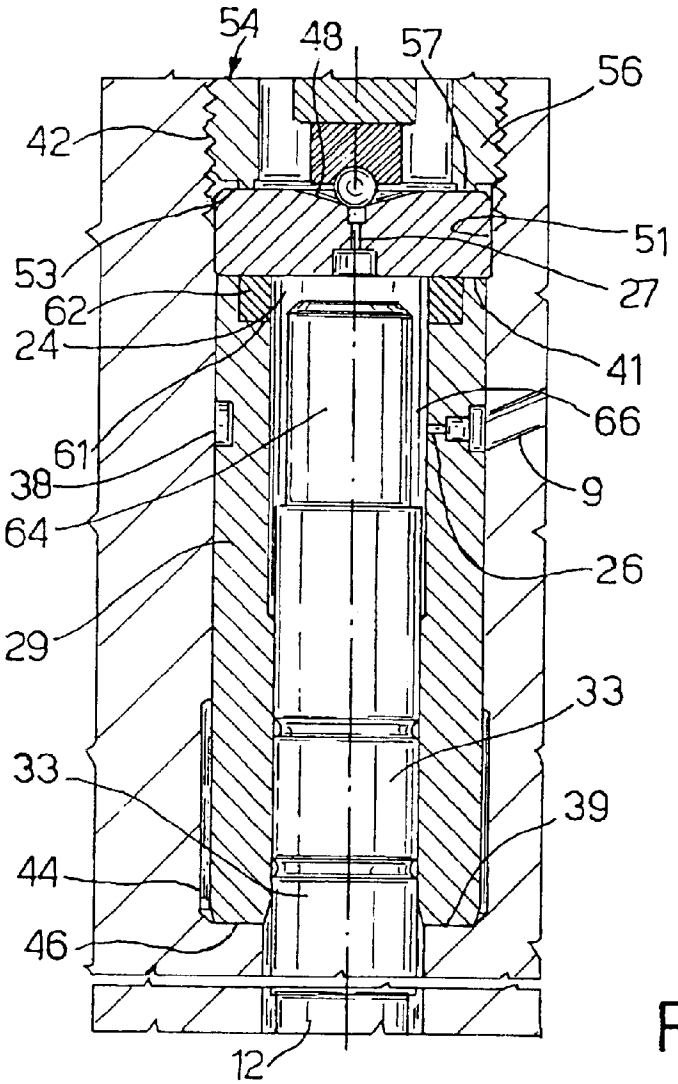
FIG. 5 shows the same section of a variation of the FIG. 4 embodiment.
Figure 4:
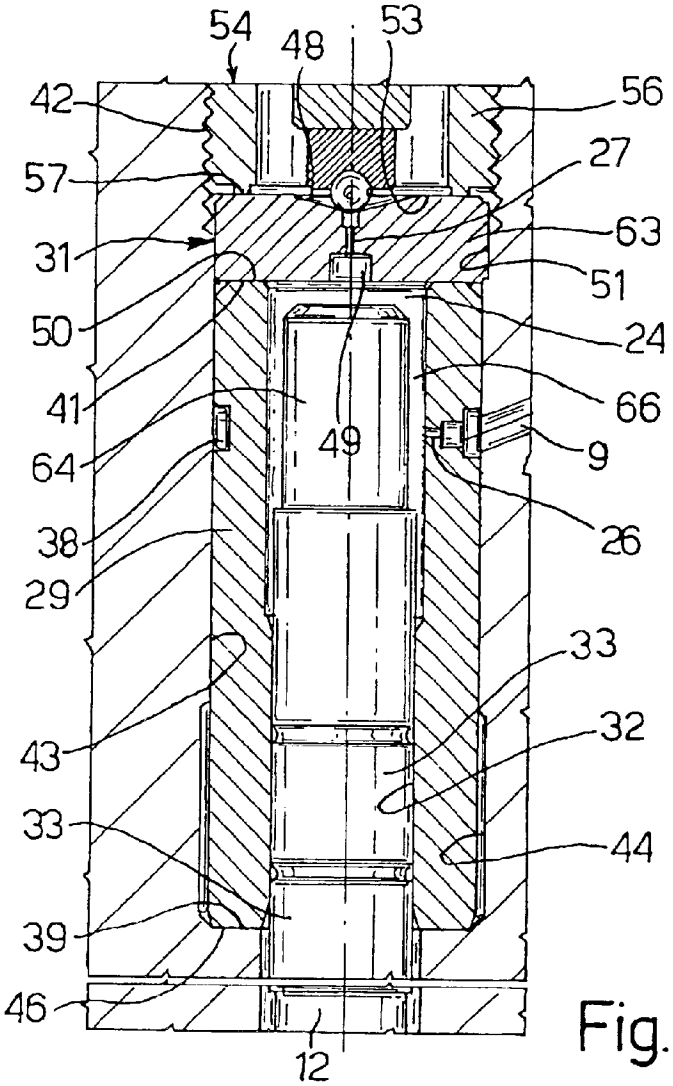
FIG. 4 shows a partial mid-section of a further embodiment of the invention.

In the FIGS. 4 and 5 embodiment, plug member 31 is defined by a straightforward disk 63 engaged by projection 57 of ring nut 54 for fluidtight assembly to edge 41 of bush 29. To allow pressurized fuel flow through calibrated hole 26 of the inlet conduit into control chamber 24, an end portion 64 of portion 33 of rod 12 is smaller in diameter to form a gap 66 with through opening 32 of bush 29. The volume of gap 66 is added to that of control chamber 24 to compensate for the reduction in volume caused by the reduction in the length of prehole 49. Since disk 63 has a shorter prehole 49 than in the FIGS. 1–3 embodiments, calibrated hole 27 in disk 63 may be formed working through prehole 49, so that the two are more easily made coaxial.

In the FIG. 5 variation, as in FIG. 3, bush 29 comprises annular recess 61 housing seal 62 of elastomeric material to reduce the diameter of the sealing area and ensure sealing even in the presence of minor roughness of the two contacting metal surfaces.

The FIGS. 4 and 5 variations are assembled in the same way as the FIGS. 1–3 embodiments already described.

According to the invention, the method of fabricating injector 5 comprises the steps of:

forming injector body 6 with seat 23 for metering valve 14;

forming control chamber 24 in two parts 29, 31, part 29 guiding control rod 12 and having one of conduits 26, 27, and part 31 closing control chamber 24 and having the other of conduits 26, 27;

subsequently inserting parts 29 and 31 inside seat 23; and locking parts 29 and 31 to each other inside seat 23 by means of a fastening member 54.

More specifically, the method comprises the steps of:

forming said seat 23 in said injector body 6 with at least one cylindrical portion 43 of a given diameter, with a shoulder 46 at one end, and with a threaded portion 42 at the other end;

forming one of said parts in the form of a bush 29 having a substantially cylindrical axial through opening 32, and an outer surface 37 having an annular groove 38 at said inlet conduit 26;

machining the outer surface 37 of bush 29 to such a diameter as to obtain a small amount of interference with said cylindrical portion 43 of seat 23;

forming the other of said parts in the form of a plug member 31 for engaging a first end 41 of said bush 29 in fluidtight manner;

forming said fastening member in the form of a ring nut 54 for engaging said plug member 31;

driving said bush 29 firmly inside said cylindrical portion 43 of seat 23 so that a second end 39 of bush 29 rests on said shoulder 46;

inserting said plug member 31 inside said seat 23; and screwing said ring nut 54 inside said threaded portion 42 to ensure pressurized-fuel sealing between said plug member 31 and said first end 41 of bush 29.

The advantages, as compared with known injectors, of the injectors according to the invention will be clear from the foregoing description. In particular, forming control chamber 24 in two parts 29, 31 simplifies machining of the inside of chamber 24; driving bush 29 into cylindrical portion 43 of seat 23 provides for direct sealing of the pressurized fuel in distribution chamber 38; whereas the slight interference between bush 29 and cylindrical portion 43 prevents any deformation of the two parts during assembly, and makes subsequent grinding superfluous.

Being substantially of the same diameter as bush 29 and plug member 31, the fastening force of ring nut 54 is exerted over the thickness of bush 29; projection 57 of ring nut 54 provides for concentrating the fastening force over a smaller diameter, thus ensuring optimum fastening; and forming the two calibrated holes 26, 27 in two separate parts 29, 31 enables parts 29, 31 to be selected when assembling injector 5, thus simplifying part storage.

Clearly, changes may be made to the injectors and fabrication method as described herein without, however, departing from the scope of the accompanying Claims.

For example, bush 29 may be other than circular in section; top surface 47 of plug member 31 may be flat as opposed to truncated-cone-shaped; and the inlet conduit of control chamber 24 and the drain conduit may be parallel and perpendicular to rod 12 respectively.

Figure 6:
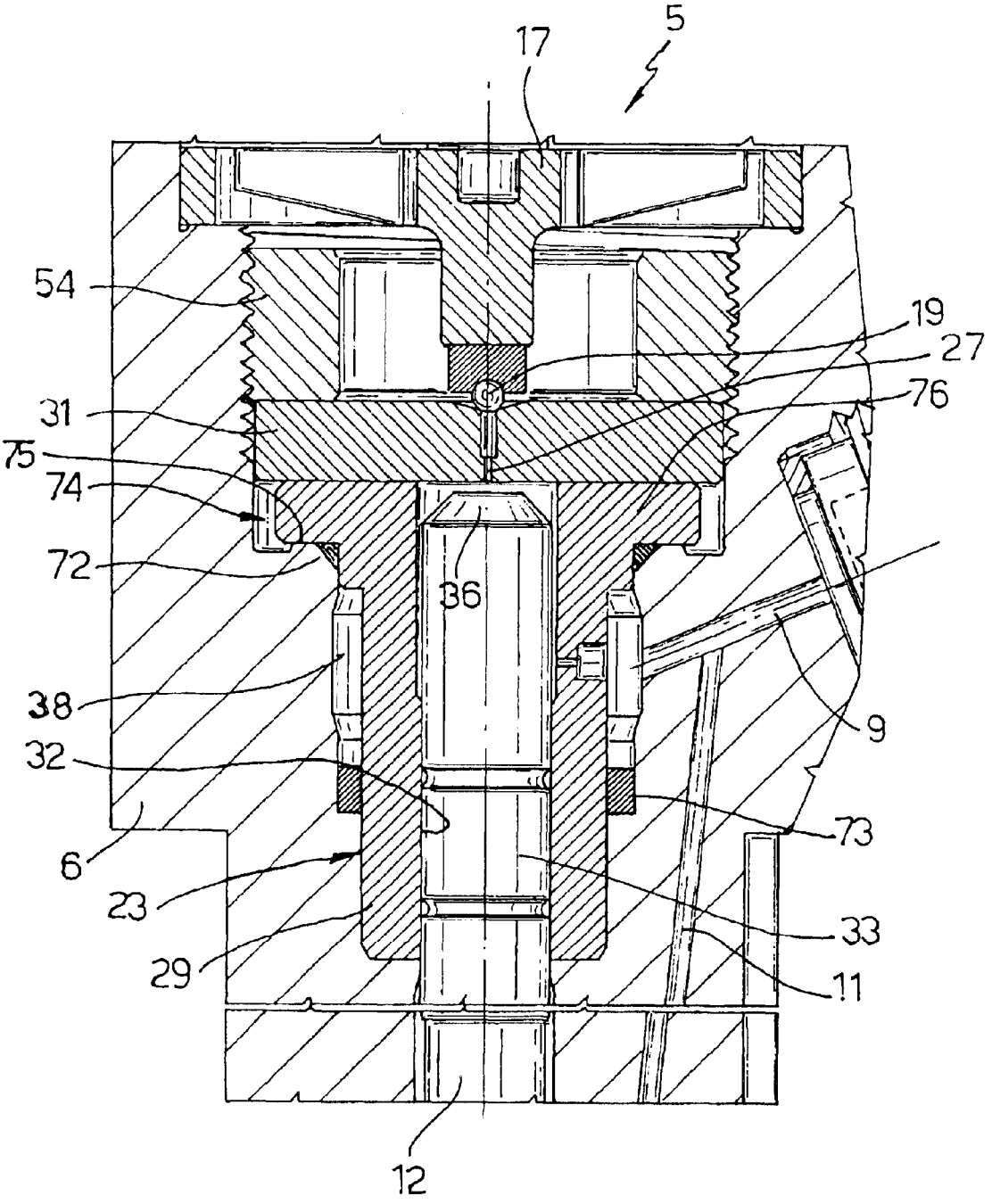
FIG. 6 shows a partial mid-section of a further embodiment of the invention.

FIG. 6 shows a further embodiment of the present invention, in which any parts similar or corresponding to those of the other embodiments are indicated using the same reference numbers.

More specifically, the FIG. 6 injector differs from those in FIGS. 1–5 by bush 29 being fixed conventionally to injector body 6 as opposed to interferentially.

More specifically, as shown in FIG. 6, bush 29 is inserted radially loosely inside injector body 6, and two sealing rings 72, 73 of elastomeric material are provided on opposite axial sides of annular groove 38, between injector body 6 and bush 29, to prevent the high-pressure fuel fed into annular groove 38 along feed conduit 9 from leaking into the gap between injector body 6 and bush 29.

Also, seat 23 housing bush 29 comprises a wider top chamber 74 defined axially by an annular shoulder 75 of injector body 6, and which houses plug member 31 and ring nut 54; and bush 29 has a substantially T-shaped section, and comprises a wide top end portion 76 resting on annular shoulder 75.

What is claimed is:

1. An internal combustion engine fuel injector comprising an injector body having a seat for a metering valve in turn having a control chamber for controlling a control rod; said control chamber having a pressurized-fuel inlet conduit and a drain conduit controlled by a corresponding shutter;

wherein said control chamber is defined by two coaxial parts fixed in said seat; one of said parts guiding said control rod and having one of said conduits; and the other of said parts closing said control chamber and having the other of said conduits; and wherein said one part is defined by a hollow member having a substantially cylindrical through opening and said inlet conduit; said hollow member being housed in said seat and guiding said control rod axially; said other part being defined by a plug member having said drain conduit and engaging in fluidtight manner a first end edge of said hollow member to close said through opening.

2. The injector as claimed in claim 1, wherein said hollow member is defined by a bush having an annular groove in which said inlet conduit terminates; said seat being substantially cylindrical and comprising an annular shoulder engaged by another end edge of said bush.

3. The injector as claimed in claim 2, wherein said seat comprises a threaded portion engaged by a ring nut for fastening said plug member so as to provide, together with said first end edge, for pressurized-fuel sealing.

4. The injector as claimed in claim 3, said bush has an outside diameter enabling it to be driven inside at least one cylindrical portion of said seat with a minimum amount of interference, so that said second end edge contacts said annular shoulder.

5. The injector as claimed in claim 4, wherein said at least one cylindrical portion or said seat and/or an outer surface of said bush are finish ground or lapped, and have an interference of 5 to 10 microns.

6. The injector as claimed in claim 4, wherein said ring nut comprises a lateral wall; said ring nut having an annular projection substantially adjacent to an inner surface of said lateral wall to concentrate the fastening force of said ring nut on said plug member.

7. The injector as claimed in claim 6, wherein said lateral wall has substantially the same outside diameter as said bush and has a thickness of about 40% less than that of said bush, so that said projection acts substantially along the centerline of the thickness of said bush.

8. The injector as claimed in claim 6, wherein said plug member comprises an annular surface which engages an annular surface of said first end edge; said annular surfaces being machined to ensure said sealing by virtue of the action of said ring nut.

9. The injector as claimed in claim 6, wherein said first end edge comprises an annular recess located at said through opening for housing a seal; said plug member having an annular surface which engages said seal to provide for sealing by virtue of the action of said ring nut.

10. The injector as claimed in claim 1, wherein said through opening is cylindrical; said plug member comprising a flange integral with a cylindrical appendix housed in said through opening; and said appendix being so sized as to define a predetermined volume of said control chamber.

11. The injector as claimed in claim 10, wherein said inlet conduit comes out inside said through opening in a region between said appendix and an end surface of said control rod positioned to open the injector.

12. The injector as claimed in claim 1, wherein said through opening is cylindrical, and said plug member is in the form of a disk; said control rod comprising a small-diameter end portion so as to define a predetermined volume of said control chamber.

13. The injector as claimed in claim 12, wherein said inlet conduit comes out at said end portion of said control rod positioned to open the injector.

14. A method of fabricating an internal combustion engine fuel injector comprising an injector body having a seat for a metering valve in turn having a control chamber for controlling a control rod; said control chamber having a pressurized-fuel inlet conduit and a drain conduit controlled by a corresponding shutter; the method comprising the steps of: forming said injector body with the seat for said metering valve; forming said control chamber in two parts, one for guiding said control rod and having one of said conduits, and the other for closing said control chamber and having the other of said conduits: subsequently inserting said parts inside said seat; and locking said parts to each other in said seat by means of a fastening member.

15. The method as claimed in claim 14, further comprising the steps of: forming said seat in said injector body with at least one cylindrical portion of a given diameter, with a shoulder at one end, and with a threaded portion at the other end; forming one of said parts in the form of a bush having a substantially cylindrical axial through opening, and an outer surface having an annular groove at said inlet conduit; machining said outer surface to such a diameter as to obtain a small amount of interference with said cylindrical portion of said seat; forming the other of said parts in the form or a plug member for engaging a first end edge of said bush in fluidtight manner; forming said fastening member in the form of a ring nut for engaging said plug member; driving said bush firmly inside said cylindrical portion of the seat so that a second end edge of the bush rests on said shoulder; inserting said plug member inside said seat; and screwing said ring nut inside said threaded portion to ensure pressurized-fuel sealing between said plug member and said first end edge of the bush.

16. The method as claimed in claim 15, wherein said first end edge of the bush is formed with an annular recess for housing a seal; said seal being inserted inside said annular recess before said plug member is inserted inside said seat.

17. The method as claimed in claim 15, wherein the interference between said outer surface of said bush and at least said cylindrical portion of said seat is 5 to 10 microns.

* * * * *